US007150073B2

(12) United States Patent
Stewart

(10) Patent No.: US 7,150,073 B2
(45) Date of Patent: Dec. 19, 2006

(54) HINGE PIN

(75) Inventor: Jason Stewart, Madison, IN (US)

(73) Assignee: Delaware Capital Formation, Inc., Wilmington, DE (US)

( * ) Notice: Subject to any disclaimer, the term of this patent is extended or adjusted under 35 U.S.C. 154(b) by 137 days.

(21) Appl. No.: 10/833,266

(22) Filed: Apr. 27, 2004

(65) Prior Publication Data

US 2005/0235460 A1 Oct. 27, 2005

(51) Int. Cl.
*E05D 11/10* (2006.01)

(52) U.S. Cl. ..... 16/354; 16/356

(58) Field of Classification Search ..... 16/354, 16/356, 363, 374, 380, 337, 348, 317–319, 16/297, 231, 221, 347; 254/45
See application file for complete search history.

(56) References Cited

U.S. PATENT DOCUMENTS 661,680 A * 11/1900 Andreas ..... 16/317
1,713,704 A 5/1929 Lobel
2,508,974 A 5/1950 Soditch et al.
2,576,908 A 11/1951 Wallace
2,764,869 A 10/1956 Scherr
2,786,549 A 3/1957 Tozloski
2,846,570 A 8/1958 Harling
2,891,765 A 6/1959 Pearne
2,942,848 A 6/1960 Friesen
2,984,072 A 5/1961 Born
3,053,050 A 9/1962 Sommerer
3,265,357 A 8/1966 Schilling
3,289,868 A 12/1966 Miller et al.
3,330,381 A 7/1967 Halstead
3,377,924 A 4/1968 Spencer
3,414,086 A 12/1968 Ulinski
3,423,898 A 1/1969 Tracy et al.
3,556,480 A 1/1971 Johansson
3,596,941 A 8/1971 Tracy
3,638,535 A 2/1972 Ponter
3,653,302 A 4/1972 Notenboom
3,696,712 A 10/1972 Sung
3,757,899 A 9/1973 Smith
3,869,149 A 3/1975 Dixon
D235,987 S 7/1975 Mono
3,967,701 A 7/1976 Hegenbart
3,968,730 A 7/1976 Lionet
4,201,053 A 5/1980 Atkey
4,230,304 A 10/1980 Tol
4,241,901 A 12/1980 Shircliffe
4,267,901 A 5/1981 Tsujimura (Continued)

FOREIGN PATENT DOCUMENTS

DE 3433136 3/1986

(Continued)

OTHER PUBLICATIONS

Patent Abstracts of Japan, vol. 15, No. 404 (M-1168) Oct. 15, 1991.

*Primary Examiner*—Robert J. Sandy
*Assistant Examiner*—Andre' L. Jackson
(74) *Attorney, Agent, or Firm*—Frost Brown Todd LLC

(57) ABSTRACT

A hinge pin is suited for use in a hinge for a rotatable arm of a vehicle lift. The hinge pin has a groove formed within its side surface. The groove is configured to permit engagement of the pin with a restraining member configured to prevent rotation of the arm. The engagement of the pin with the restraining member limits longitudinal movement of the pin.

19 Claims, 3 Drawing Sheets

U.S. PATENT DOCUMENTS

| | | | | | |
|---|---|---|---|---|---|
| 4,447,042 | A | | 5/1984 | Masui | |
| 4,452,340 | A | | 6/1984 | Hernick et al. | |
| D277,795 | S | | 2/1985 | Griffiths | |
| 4,500,071 | A | | 2/1985 | Bagwell et al. | |
| 4,570,290 | A | * | 2/1986 | Anderson | 16/229 |
| 4,614,454 | A | * | 9/1986 | Kassai | 403/62 |
| 4,679,489 | A | | 7/1987 | Jasinski et al. | |
| 4,706,458 | A | | 11/1987 | Corghi | |
| 4,715,477 | A | | 12/1987 | Suzuki | |
| 4,726,281 | A | | 2/1988 | De Filippi | |
| 4,763,761 | A | | 8/1988 | McKinsey et al. | |
| 4,777,798 | A | | 10/1988 | Jacobson et al. | |
| 4,804,066 | A | | 2/1989 | Fusaro et al. | |
| 4,825,977 | A | | 5/1989 | Isogai | |
| 4,848,732 | A | | 7/1989 | Rossato | |
| 4,976,336 | A | | 12/1990 | Curran | |
| 5,009,287 | A | | 4/1991 | Starr | |
| 5,024,141 | A | | 6/1991 | Kawada | |
| 5,050,844 | A | | 9/1991 | Hawk | |
| 5,052,520 | A | | 10/1991 | Wakamiya | |
| 5,065,844 | A | | 11/1991 | Hon | |
| 5,096,159 | A | | 3/1992 | Fletcher et al. | |
| 5,143,179 | A | | 9/1992 | Hornstein | |
| 5,157,228 | A | | 10/1992 | Ackermann et al. | |
| 5,199,686 | A | | 4/1993 | Fletcher | |
| 5,214,409 | A | | 5/1993 | Beigel | |
| 5,299,658 | A | | 4/1994 | Cox et al. | |
| D359,947 | S | | 7/1995 | Greene | |
| 5,501,296 | A | | 3/1996 | Fletcher | |
| D374,535 | S | | 10/1996 | Feider et al. | |
| 5,573,083 | A | | 11/1996 | Fletcher et al. | |
| D376,244 | S | | 12/1996 | Feider et al. | |
| 5,597,987 | A | | 1/1997 | Gilliland et al. | |
| D384,478 | S | | 9/1997 | Prehn et al. | |
| 5,679,934 | A | | 10/1997 | Juntunen et al. | |
| 5,711,512 | A | | 1/1998 | Kauffman | |
| 5,740,886 | A | | 4/1998 | Fletcher | |
| D395,116 | S | | 6/1998 | Okerlund et al. | |
| 5,860,491 | A | | 1/1999 | Fletcher | |
| 5,929,399 | A | | 7/1999 | Jamieson et al. | |
| 5,983,589 | A | | 11/1999 | Daudet | |
| 6,012,201 | A | * | 1/2000 | Mitts et al. | 16/334 |
| 6,062,406 | A | * | 5/2000 | Duncan | 213/156 |
| 6,116,140 | A | | 9/2000 | Barthalow et al. | |
| 6,164,415 | A | | 12/2000 | Takeuchi | |
| 6,189,432 | B1 | | 2/2001 | Colarelli et al. | |
| 6,516,495 | B1 | * | 2/2003 | Michalak | 16/320 |
| D472,359 | S | | 3/2003 | Green et al. | |
| 6,817,062 | B1 | * | 11/2004 | Cho | 16/328 |
| 6,832,412 | B1 | * | 12/2004 | Kim | 16/354 |
| 6,926,363 | B1 | * | 8/2005 | Yamashita | 297/366 |

FOREIGN PATENT DOCUMENTS

| | | |
|---|---|---|
| DE | 9115317 | 3/1992 |
| DE | 19539288 | 5/1996 |
| FI | 944980 | 4/1996 |
| FR | 1269947 | 8/1964 |
| JP | 03166199 | 7/1991 |
| JP | 8208157 | 8/1996 |
| JP | 8333093 | 12/1996 |
| JP | 3053758 | 6/2000 |
| WO | WO 9311517 | 6/1993 |
| WO | WO 9511189 | 4/1995 |
| WO | WO 0164574 | 9/2001 |

* cited by examiner

HINGE PIN

BACKGROUND OF THE INVENTION

The present invention relates generally to hinge pins, and is particularly directed to a hinge pin that may be used with pivoting swing arms of a vehicle lift.

Two-post vehicle lifts typically have pairs of rotatable arms hingedly attached to a carriage that is reciprocable vertically along a vertical post assembly. The carriage typically has an arm mount comprising a pair of spaced-apart flanges providing two axially aligned openings that are configured to be aligned with a pair of axially aligned openings on two flanges of a rotatable arm. When all four openings are so aligned, a hinge pin is inserted in the openings and held in place, providing a hinge or axis for rotation. With the pin in place, the rotatable arm is secured to the carriage and may be selectively rotated about the axis provided by the hinge pin. Such lifts will typically also have a means for selectively preventing the arm from further rotation when the arm has been rotated to a desired position.

Typical hinge pins include a washer welded to one end of the pin and a transverse hole drilled through the side of the pin. Typically, the washer prevents the pin from sliding longitudinally downward through and out of the openings in which the pin is disposed. After the hinge pin has been inserted into the openings and thus properly positioned, a cotter pin is typically inserted into the drilled hole of the standard hinge pin to prevent longitudinally upward movement.

Such hinge pins have several shortcomings. For example, the steps of welding the washer to the end of the hinge pin and drilling the hole in the hinge pin typically require additional machinery beyond the machinery required to produce the pin prior to the welding and drilling. These production steps, as well as the step of inserting the cotter pin in the drilled hole, also cost time and money.

Thus, there exists a need for a hinge pin suited for use with a rotatable arm of a vehicle lift that overcomes these and other shortcomings of standard hinge pins.

BRIEF DESCRIPTION OF THE DRAWINGS

The accompanying drawings incorporated in and forming a part of the specification illustrate several aspects of the present invention, and together with the description serve to explain the principles of the invention; it being understood, however, that this invention is not limited to the precise arrangements shown. In the drawings.

Reference will now be made in detail to the present preferred embodiment of the invention, an example of which is illustrated in the accompanying drawings.

DETAILED DESCRIPTION OF AN EMBODIMENT OF THE INVENTION

Figure 1:
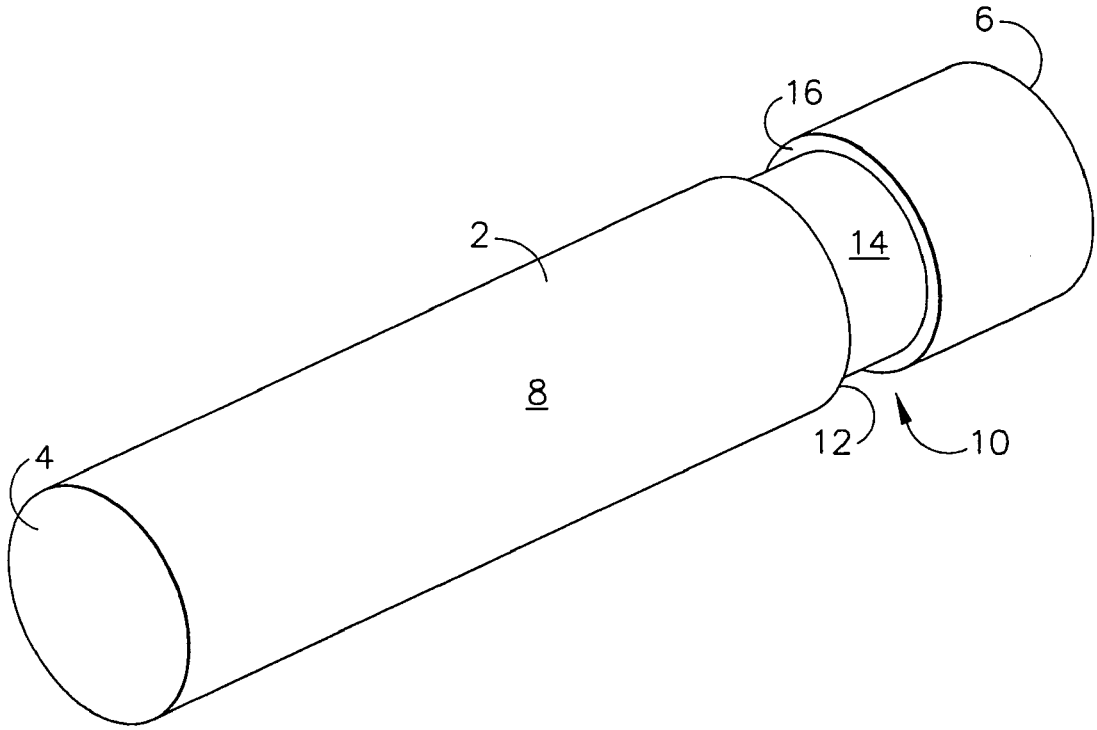
FIG. 1 is a perspective view of a hinge pin constructed in accordance with the teachings of the present invention.

Referring now to the drawings in detail, wherein like numerals indicate the same elements throughout the views, FIG. 1 shows pin 2 suited for use as a hinge pin in vehicle lift 20. While the present example discloses pin 2 in the context of a vehicle lift 20, it will be appreciated that pin 2 will be well suited for a variety of applications. By way of example only, pin 2 will be particularly suited for use as a hinge pin for any rotatable member.

As shown in FIG. 1, pin 2 is cylindraceous, and in particular, cylindrical. It will be appreciated that pin 2 may have any other cylindraceous configuration. Pin has first end 4, second end 6, and side surface 8. Groove 10 is formed in side surface 8 proximate to second end 6.

In the present example, groove 10 is defined by first surface 12, second surface 14, and third surface 16. As shown, first 12 and third 16 surfaces are generally perpendicular to the longitudinal axis of pin 2, while second surface 14 is generally parallel to longitudinal axis of pin 2. However, it will be appreciated that groove 10 may be of any other suitable configuration.

Pin 2 may be formed with groove 10 by any suitable method known in the art. By way of example only, pin 2 may be formed and cut to size, and groove 10 may formed therein, by a single automated lathe. Of course, any other suitable method may be used, such as casting or other methods.

Figure 2:
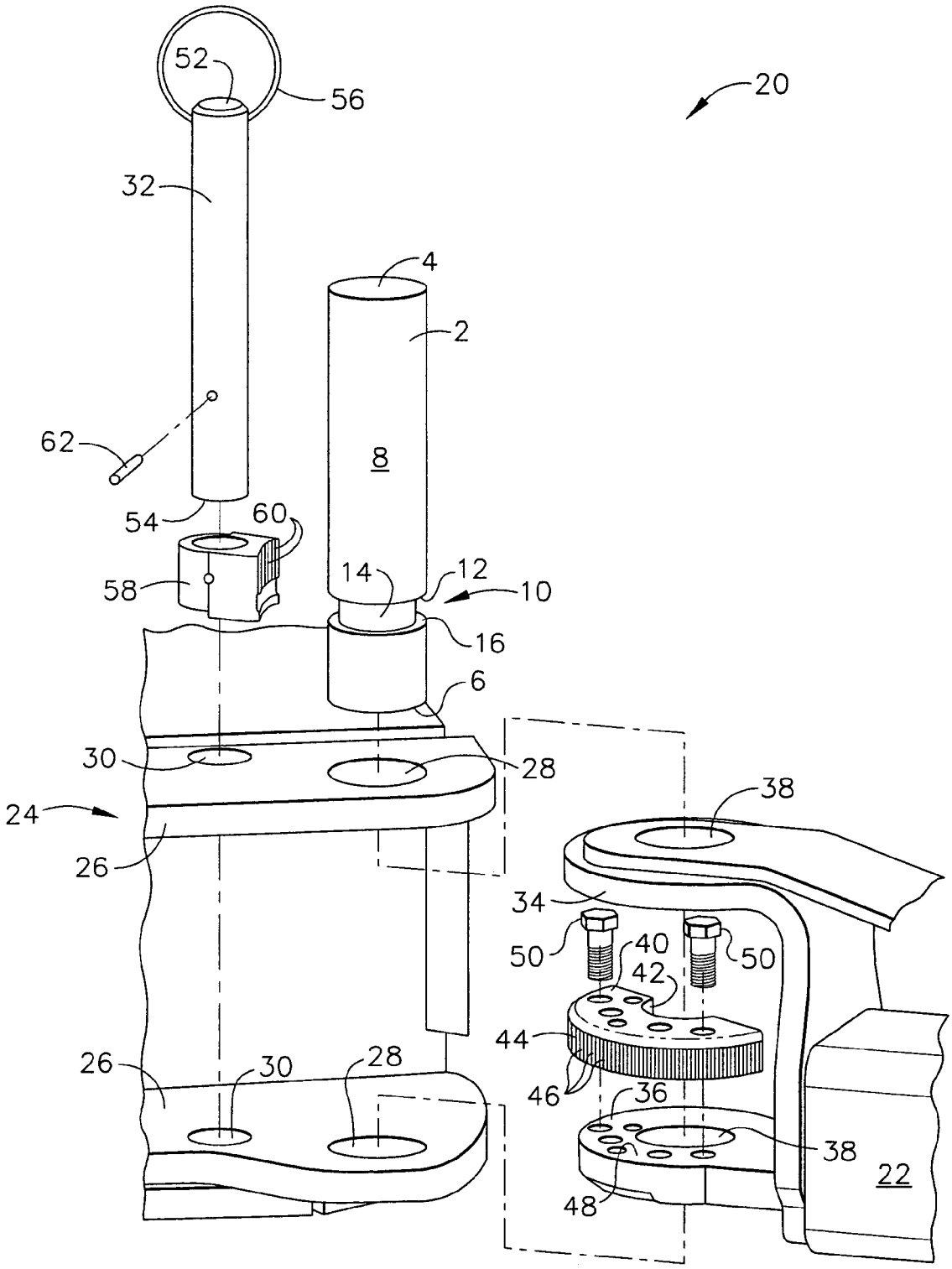
FIG. 2 is a partial exploded perspective view of the hinge pin of FIG. 1 and a vehicle carriage, rotatable arm, and restraining member.
Figure 3:
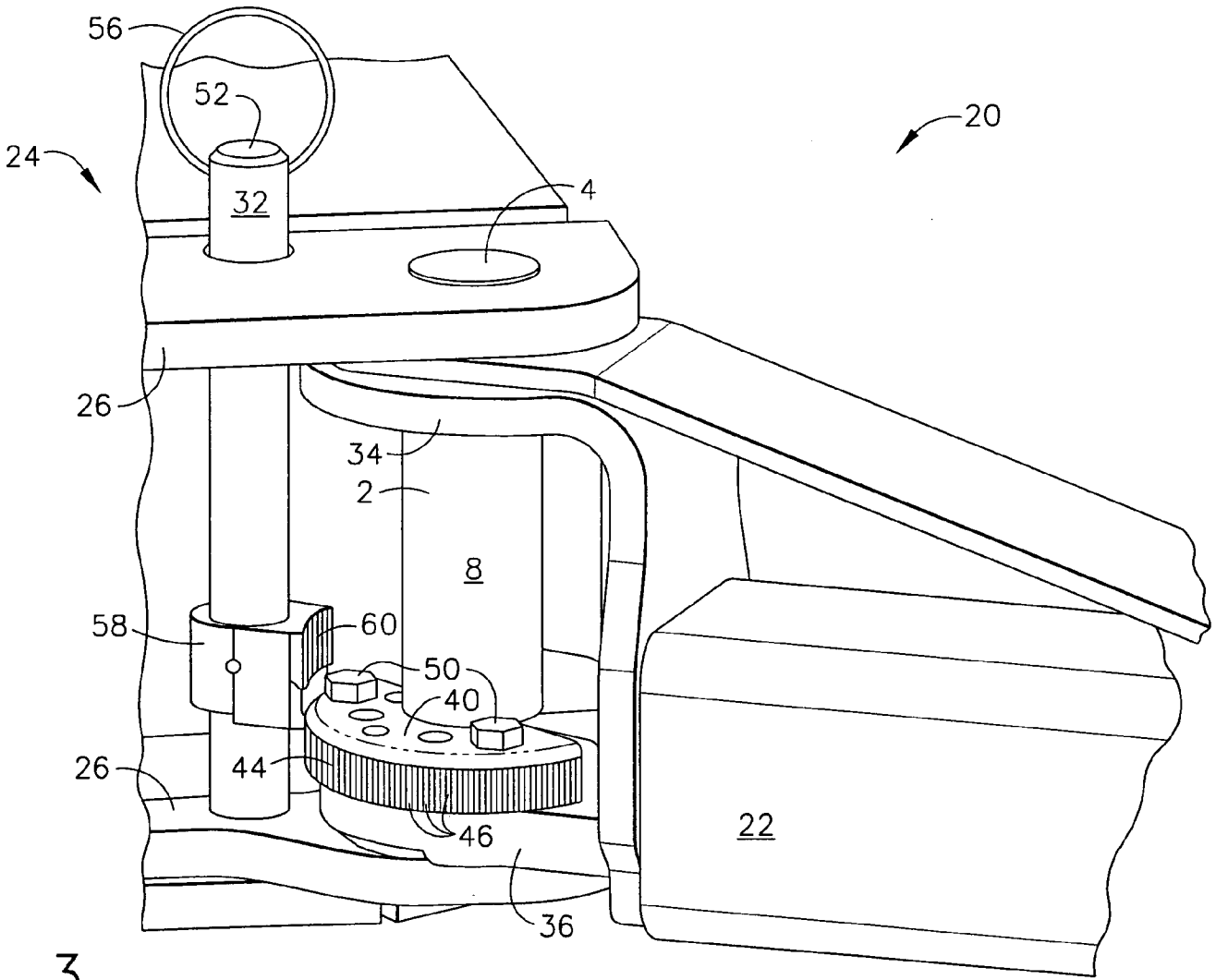
FIG. 3 is a perspective view of the hinge pin of FIG. 1 and a vehicle carriage, rotatable arm, and restraining member.

FIGS. 2 and 3 show pin 2 specifically in the context of vehicle lift 20. In particular, FIGS. 2 and 3 show how pin 2 may be used as a hinge pin for rotatable arm 22 of vehicle lift 20. However, it will be appreciated that pin 2 may be used in a variety of other applications.

Vehicle lift 20 includes carriage 24 and arm 22. Carriage 24 includes arm mount 26, comprising a pair of axially aligned pin openings 28 configured to receive pin 2, and locking pin openings 30 configured to receive locking pin 32. Pin 2 and pin openings 28 of arm mount 26 may be configured such that pin 2 may rotate when disposed in pin openings 28 (e.g., pin openings 28 are of a diameter that is at least as great as diameter of pin 2).

Arm 22 has upper flange 34 and lower flange 36, each flange 34 and 36 having pin opening 38 configured to receive pin 2. Pin openings 38 in flanges 34 and 36 are axially aligned. Pin openings 38 in flanges 34 and 36 may be configured similar to pin openings 28 in arm mount 26 (e.g., same shape and size), although other configurations may be used. If pin openings 28 of arm mount 26 are not configured to allow pin 2 to rotate when disposed in pin openings 28, pin openings 38 in flanges 34 and 36 may be configured to permit rotation of arm 22 about pin 2.

Vehicle lift 20 also includes restraining member 40. In the present example, restraining member 40 is generally flat and semicircular, including a smooth semicircular inner surface 42 and a semicircular outer surface 44 comprising a plurality of splines 46. In the depicted embodiment, restraining member 40 is configured to be fixedly mounted to top surface 48 of lower flange 36 of arm 22. Inner surface 42 of restraining member 40 is configured to mate with groove 10 of pin 2.

During assembly of vehicle lift 20 in the present example, arm 22 will be positioned such that pin openings 38 in flanges 34 and 36 of arm 22 are axially aligned with pin openings 28 in arm mount 26. With arm 22 so positioned, pin 2 may be inserted through openings 28 and 38. With pin 2 disposed in openings 28 and 38, restraining member 40 is placed such that inner surface 42 mates with groove 10, resulting in engagement between pin 2 and restraining member 40. Restraining member 40 is then fixedly mounted to lower flange 36. Restraining member 40 may be fixedly mounted to lower flange 36 by one or more bolts 50, as illustrated in the present example, or any other suitable means known in the art. Where one or more bolts 50 are used, for example, restraining member 40 may be loosely attached to lower flange 36 prior to any of the above steps. In this embodiment, where clearance for doing so is provided, after arm 22 and pin 2 have been properly positioned, restraining member 40 may be moved radially inward into engagement with pin 2 at groove 10, and the bolts 50 may then be tightened to prevent further radial movement of restraining member 40.

In the present example, pin 2 is of sufficient length, and groove 10 is positioned on the axis of pin 2, such that pin 2 remains disposed in all pin openings 28 and 38 when pin 2 is engaged with restraining member 40 and restraining member 40 is attached to lower flange 36. It will be appreciated that, under the above conditions, engagement of restraining member 40 with pin 2 at groove 10 will limit longitudinal movement of pin 2 within pin openings 28 and 38. In the present example, this limitation of longitudinal movement prevents pin ends 4 and 6 from passing through openings 28 and 38. This limitation is imposed upon pin 2 until restraining member 40 is removed from lower flange 36 or allowed to move radially outward, away from pin 2, such that restraining member 40 and pin 2 are no longer engaged. It will be appreciated that engagement of pin 2 and restraining member 40 need not absolutely prohibit all longitudinal movement of pin 2.

Locking pin 32 has first 52 and second 54 ends and includes pull ring 56 located proximate first end 52 and locking member 58 located proximate second end 54. Locking member 58 is attachable to locking pin 32 and has a plurality of splines 60. Rotational and axial movement of locking member 58 with respect to locking pin 32 may be limited by a restraint pin 62. Splines 60 on locking member 58 are configured to engage with splines 46 on restraining member 40. Locking pin 32 is configured to be slidably disposed within locking pin openings 30 of arm mount 26. In the present example, locking pin openings 30 and pin openings 28 in arm mount 26 are spaced such that, when pin 2 and locking pin 32 are properly positioned, splines 60 on locking member 58 may selectively be engaged with splines 46 on restraining member 40. In the present example, engagement of splines 46 and 60 will prevent rotation of arm 22 until splines 60 and 46 are disengaged.

By way of example only, engagement and disengagement of splines 46 and 60 may be a function of axial positioning of locking pin 32 within locking pin openings 30. In the present example, a user may disengage splines 46 and 60 by pulling ring 56 to axially withdraw locking pin 32 sufficient to disengage splines 46 and 60. With locking pin 32 so withdrawn, the user may rotate arm 22 to the desired position. When arm 22 has reached the desired position, and further rotation of arm 22 is no longer desired, user may axially advance locking pin 32 such that splines 46 and 60 are engaged.

Of course, the prevention of the rotation of arm 22 need not necessarily be accomplished by splines 60 on locking pin 32 engaging with splines 46 on restraining member 40. Those of ordinary skill in the art will immediately recognize that there are a vast number of alternative means for the selective prevention of rotation of arm 22. It not intended that the scope of the present invention be limited to the illustrative example described thus far.

It will be apparent to those of skill in the art that while a preferred embodiment of the invention has been disclosed in detail, numerous other modifications and improvements may be made thereon. Some, but not all, alternate embodiments are described below.

For example, groove 10 formed in pin 2 need not be fully annular. It will be appreciated that, where groove 10 is not fully annular (i.e. it does not extend around full circumference of pin 2) and inner surface 42 of restraining member 40 is complimentarily sized, torque may be transferred to pin 2 from arm 22 through restraining member 40. In other words, where groove 10 is not fully annular, pin 2 may rotate, at least in part, with arm 22 and restraining member 40. Thus, in this embodiment, pin 2 will preferably not be engaged with arm mount 26 such that arm mount 26 will strictly prohibit any rotation of pin 2, and hence, rotation of arm 22. In other words, arm mount 26 should permit at least some free rotation of pin 2 in this embodiment.

Alternatively, pin 2 and arm mount 26 may be configured such that pin 2 is not permitted to rotate at all within pin openings 28 of arm mount 26.

In this embodiment, pin 2 and restraining member 40 will preferably be engaged such that restraining member 40 and arm 22 may at least partially rotate about pin 2. Such rotation may be permitted by providing a fully annular groove 10 in pin 2, for example. Alternatively, where groove 10 is not fully annular, inner surface 42 of restraining member 40 may be sized circumferentially smaller than groove 10, for example, such that only partial rotation of restraining member 40 and arm 22 is permitted.

In addition, groove 10 may be defined by only one surface. In other words, groove 10 may be formed as having a constant or varying radius extending inward relative to side surface 8 of pin 2, such that groove 10 has one or more curvatures. Alternatively, groove 10 may be defined by only two surfaces. For example, groove 10 may be comprised of two annular surfaces that are each at a 45° angle relative to side surface of pin. Of course, surfaces comprising a two-surface groove may be at any other angle relative to side surface of pin.

As another alternative, groove 10 may include more than three surfaces. By way of example, more than three surfaces may be provided by groove that is not fully annular. As another example, a groove having more than three surfaces may be provided by a notched recess in the pin (e.g., a flat inner surface, a top and bottom surface transverse to the longitudinal axis of the pin, and two side surfaces parallel to the axis of the pin). Still other suitable configurations of groove 10 may be used, none of which will depart from the scope of the present invention.

In another embodiment, restraining member 40 may be fixedly secured to pin 2. This fixation may be achieved by any means or method known in the art. Where restraining member 40 is fixedly secured to pin 2 and lower flange 36 of arm 22, pin 2 should be permitted to rotate within pin openings 28 of arm mount 26.

In summary, numerous benefits have been described which result from employing the concepts of the invention. The foregoing description of one or more embodiments of the invention has been presented for purposes of illustration and description. It is not intended to be exhaustive or to limit the invention to the precise form disclosed. Obvious modifications or variations are possible in light of the above teachings. The one or more embodiments were chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. An automobile lift comprising:

(a) a carriage having an arm mount, wherein the arm mount comprises a first arm mount flange extending from the carriage and a second arm mount flange extending from the carriage, wherein each of the first and second arm mount flanges has an aperture formed therethrough;

(b) a rotatable arm having first and second spaced apart flanges for mounting the arm to the arm mount, wherein each of the first and second rotatable arm flanges has an aperture formed therethrough;

(c) a hinge pin having a side surface, the hinge pin being configured to provide an axis of rotation for the rotatable arm, the rotatable arm being held to the arm mount by the hinge pin, the hinge pin having a groove formed in the side surface, wherein the hinge pin extends through the apertures of the first and second arm mount flanges and through the apertures of the first and second rotatable arm flanges;

(d) a restraining member attached to said first rotatable arm flange, the restraining member being configured to engage the hinge pin adjacent the groove, wherein engagement of the hinge pin and the restraining member limits longitudinal movement of the hinge pin; and (e) a locking member, the locking member being configured to be selectively engaged with the restraining member, wherein rotation of the rotatable arm is prohibited when the locking member is engaged with the restraining member.

2. The automobile lift of claim 1, wherein the groove is fully annular.

3. The automobile lift of claim 1, wherein the hinge pin is configured to rotate with the rotatable arm.

4. The automobile lift of claim 1, wherein the hinge pin is prevented from rotating with the rotatable arm.

5. The automobile lift of claim 1, wherein the restraining member and the locking member each further comprise a set of splines, wherein said restraining member and said locking member are configured to engage with each other at respective said set of splines.

6. The automobile lift of claim 1, wherein the restraining member and locking member are in lateral engagement.

7. The automobile lift of claim 1, wherein the restraining member is secured directly to the first arm mount flange.

8. The automobile lift of claim 1, wherein the restraining member is attached to the first arm mount flange with one or more fasteners.

9. The automobile lift of claim 1, wherein the restraining member is fixedly secured to the hinge pin.

10. The automobile lift of claim 1, wherein the first arm mount flange and the second arm mount flange are fixed relative each other.

11. The automobile lift of claim 1, wherein a portion of the restraining member is substantially convex and a portion of the locking member is substantially concave.

12. The automobile lift of claim 11, wherein the convex portion of the restraining member is configured to engage with the concave portion of the locking member.

13. The automobile lift of claim 12, wherein each of the restraining member and the locking member comprise a plurality of complimentary splines.

14. The automobile lift of claim 1, wherein the locking member is associated with a locking pin, wherein selective displacement of the locking pin disengages the locking member from the restraining member to permit the rotatable arm to rotate.

15. The automobile lift of claim 14, wherein the locking pin is axially reciprocable to selectively cause disengagement of the locking member and the restraining member.

16. An automobile lift comprising:

(a) a carriage having an arm mount, wherein the arm mount comprises a first arm mount flange extending from the carriage and a second arm mount flange extending from the carriage;

(b) a rotatable arm having first and second spaced apart flanges for mounting the arm to the first and second arm mount flanges;

(c) a hinge pin having a side surface, the hinge pin being configured to provide an axis of rotation for the rotatable arm, the hinge pin having a groove formed in the side surface, wherein the hinge pin secures the first and second rotatable arm flanges relative to the first and second arm mount flanges while permitting rotation of the rotatable arm relative to the arm mount;

(d) a restraining member attached to said first rotatable arm flange, the restraining member being configured to engage the hinge pin adjacent the groove, wherein engagement of the hinge pin and the restraining member limits longitudinal movement of the hinge pin; and (e) a locking member, the locking member being configured to be selectively engaged with the restraining member, wherein rotation of the rotatable arm is prohibited when the locking member is engaged with the restraining member.

17. The automobile lift of claim 16, wherein the restraining member is secured to the first rotatable arm flange with one or more fasteners.

18. The automobile lift of claim 16, wherein the locking member is disposed on a locking pin, wherein the locking member is selectively engageable with the restraining member through longitudinal movement of the locking pin.

19. The automobile lift of claim 16, wherein the restraining member and the locking member each further comprise a set of splines, wherein the locking member is selectively engageable with the restraining member through engaging the splines of the locking member with the splines of the restraining member.

* * * * *